US008197233B2

(12) United States Patent
Fleming

(10) Patent No.: US 8,197,233 B2
(45) Date of Patent: Jun. 12, 2012

(54) DIAPHRAGM PUMP

(75) Inventor: William T. Fleming, Morgantown, PA (US)

(73) Assignee: Dynaflo, Inc., Birdsboro, PA (US)

( * ) Notice: Subject to any disclaimer, the term of this patent is extended or adjusted under 35 U.S.C. 154(b) by 454 days.

(21) Appl. No.: 12/467,421

(22) Filed: May 18, 2009

(65) Prior Publication Data

US 2009/0285698 A1 Nov. 19, 2009

Related U.S. Application Data

(60) Provisional application No. 61/054,152, filed on May 18, 2008.

(51) Int. Cl.
*F04B 43/00* (2006.01)

(52) U.S. Cl. ..... 417/473; 92/101

(58) Field of Classification Search ..... 417/273, 417/321, 473; 91/491; 92/64, 99, 100, 101
See application file for complete search history.

(56) References Cited

U.S. PATENT DOCUMENTS

| | | | | |
|---|---|---|---|---|
| 612,834 | A | | 10/1898 | Dieckmann |
| 2,794,400 | A | | 6/1957 | Bodine, Jr. |
| 4,332,534 | A | | 6/1982 | Becker |
| 4,385,640 | A | * | 5/1983 | Iverson ..... 137/115.05 |
| 4,416,599 | A | * | 11/1983 | De Longchamp ..... 417/386 |
| 4,540,346 | A | | 9/1985 | Davies |
| 4,586,883 | A | | 5/1986 | Sumner |
| 4,963,075 | A | * | 10/1990 | Albertson et al. ..... 417/273 |
| 5,993,174 | A | | 11/1999 | Konishi |
| 6,142,061 | A | | 11/2000 | Bandieri et al. |
| 6,162,030 | A | | 12/2000 | Pierrat |
| 6,296,460 | B1 | | 10/2001 | Smith |

FOREIGN PATENT DOCUMENTS

| | | |
|---|---|---|
| JP | 61244884 | 10/1986 |
| JP | 6147102 | 5/1994 |
| JP | 20025029 A | 1/2002 |
| JP | 200561220 | 3/2005 |
| KR | 4042410 A | 5/2004 |
| KR | 6037886 A | 5/2006 |

* cited by examiner

*Primary Examiner* — Toan Ton
*Assistant Examiner* — Andrew Coughlin
(74) *Attorney, Agent, or Firm* — McNees Wallace & Nurick LLC

(57) ABSTRACT

A pump is provided including a housing and a plurality of diaphragm assemblies radially disposed within the housing, each diaphragm assembly of the plurality of diaphragm assemblies including a diaphragm. A drive element is configured to be eccentrically coupled to a rotating shaft motor to actuate the diaphragm for each of the plurality of diaphragm assemblies to draw fluid into or expel fluid from the diaphragm assembly. The drive element includes a first member and a plurality of second members, each second member of the plurality of second members being movably secured to the first member and disposed between the first member and the diaphragm of each of the plurality of diaphragm assemblies. During actuation of each diaphragm of the plurality of diaphragm assemblies, the corresponding first member and second member provide a continuously rigid radial coupling with the diaphragm.

20 Claims, 12 Drawing Sheets

DIAPHRAGM PUMP

FIELD OF THE INVENTION

The present invention is directed to a fluid pump, and more specifically, to a fluid pump having radially disposed diaphragm assemblies.

BACKGROUND OF THE INVENTION

Diaphragm-type pumps have the advantages of a fluid path that may be completely sealed from the environment, and the potential for high efficiency and long life due to a lack of sliding seals. Disadvantages of flow pulsation and limited dynamic range remain a consequence of common construction architectures typified by one (1) to four (4) reciprocating diaphragms driven directly (in the case of linear motors), or by eccentrically driven connective elements (in the case of rotating shaft motors). Flow pulsation arises due to the limited number of pumping chambers (typically one or two) actuated per drive cycle or shaft revolution. Dynamic range is typically limited due to low speed cogging, which occurs with rotating shaft motors, as a result of large angular variations in torque load to rotatably drive the shaft.

SUMMARY OF THE INVENTION

The present invention relates to a pump including a housing, a plurality of diaphragm assemblies radially disposed within the housing, each diaphragm assembly of the plurality of diaphragm assemblies including a diaphragm. A drive element is configured to be eccentrically coupled to a rotating shaft motor to actuate the diaphragm for each of the plurality of diaphragm assemblies to draw fluid into or expel fluid from the diaphragm assembly. The drive element includes a first member and a plurality of second members, each second member of the plurality of second members being movably secured to the first member and disposed between the first member and the diaphragm of each of the plurality of diaphragm assemblies. During actuation of each diaphragm of the plurality of diaphragm assemblies, the corresponding first member and second member provide a continuously rigid radial coupling with the diaphragm.

The present invention further relates to a pump including a housing and a plurality of diaphragm assemblies radially disposed in a substantially equally angularly spaced arrangement within the housing. Each diaphragm assembly of the plurality of diaphragm assemblies includes a diaphragm. A drive element is configured to be eccentrically coupled to a rotating shaft motor to actuate the diaphragm for each of the plurality of diaphragm assemblies to draw fluid into or expel fluid from the diaphragm assembly. The drive element includes a first member having a plurality of substantially identical spokes and a plurality of second members. Each second member of the plurality of second members corresponds to a spoke of the first member and movable with respect to the spoke. Each spoke of the first member and associated second member of the plurality of second members corresponds to a diaphragm assembly of the plurality of diaphragm assemblies. During actuation of each diaphragm of the plurality of diaphragm assemblies, the corresponding first member and second member of the plurality of second members provide a continuously rigid radial coupling with the diaphragm.

The present invention yet further relates to a pump including a housing and a plurality of diaphragm assemblies radially disposed in a substantially equally angularly spaced arrangement within the housing. Each diaphragm assembly of the plurality of diaphragm assemblies includes a diaphragm. A drive element is eccentrically coupled to a rotating shaft motor to actuate the diaphragm for each of the plurality of diaphragm assemblies to draw fluid into or expel fluid from the diaphragm assembly. The eccentric coupling is configured to operate in a dynamically balanced manner during operation. The drive element includes a first member having a plurality of substantially identical spokes and a plurality of second members. Each second member of the plurality of second members corresponds to a spoke of the first member and movable with respect to the spoke. Each spoke of the first member and associated second member of the plurality of second members corresponds to a diaphragm assembly of the plurality of diaphragm assemblies. During actuation of each diaphragm of the plurality of diaphragm assemblies, the corresponding first member and second member of the plurality of second members provide a continuously rigid radial coupling with the diaphragm.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
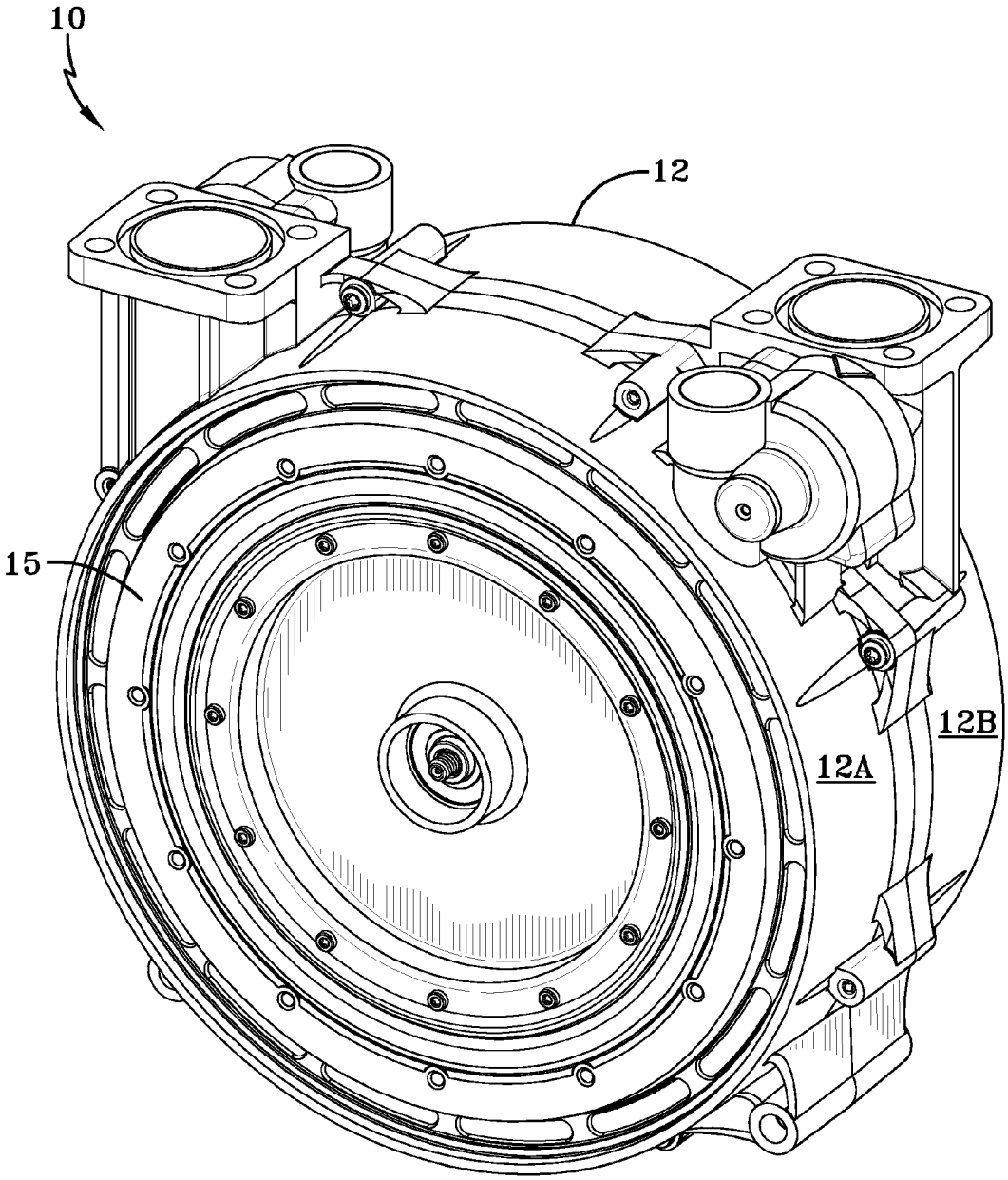
FIGS. 1 and 2 show opposed perspective views of an exemplary fluid pump.
Figure 2:
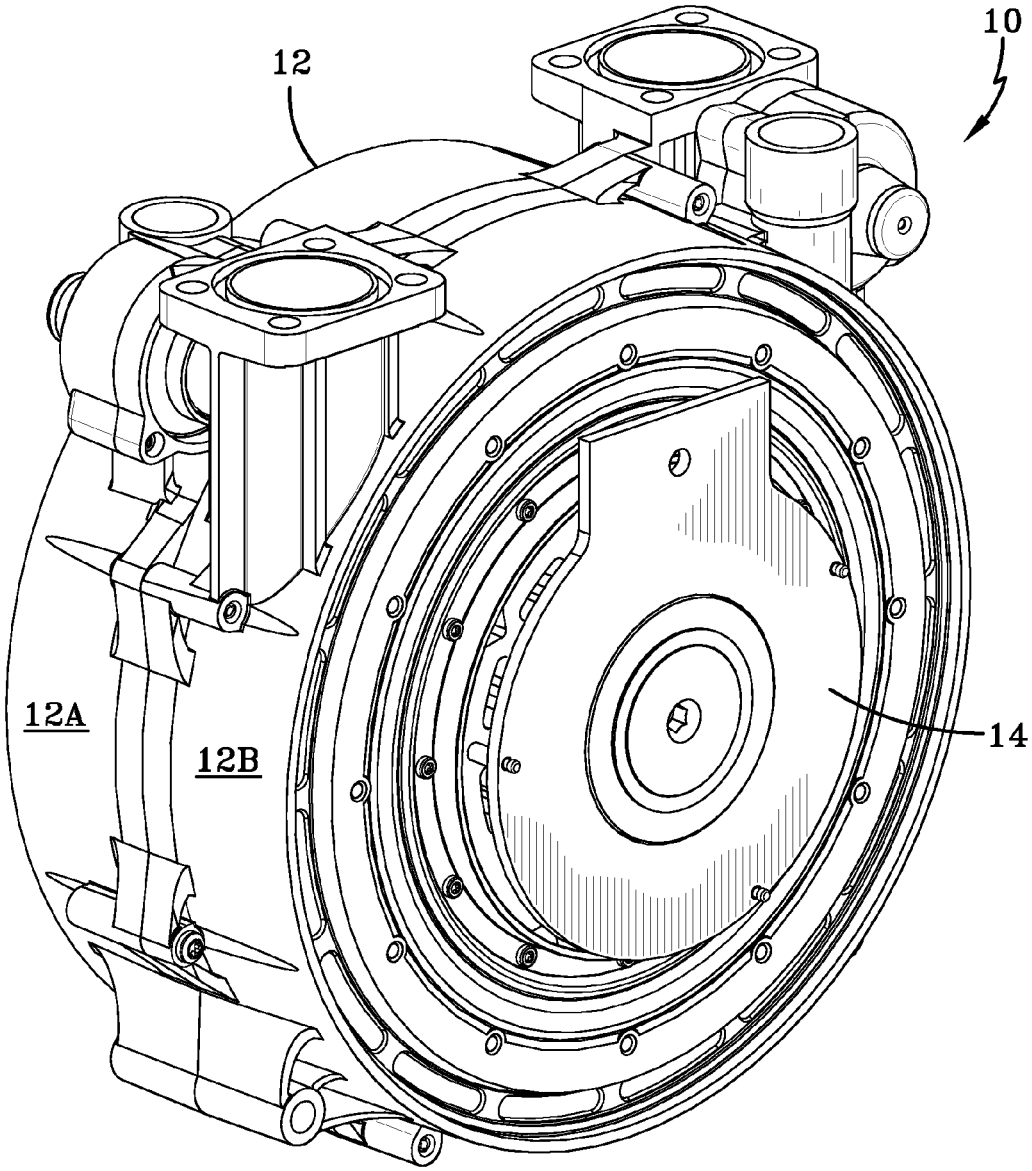

FIGS. 1-5 show an exemplary diaphragm-type pump 10. Pump 10 includes a housing 12 having housing portions 12A and 12B that surround and enclose a core assembly 22. Core assembly 22 includes manifold portions 26, 27 which surround and enclose a drive element 54 and a plurality of diaphragm assemblies 30. In one embodiment, manifold elements 26, 27 are identical. Drive element 54 is both coupled via an eccentric 84 to a shaft 82 of a motor 14 and movably secured to diaphragm assemblies 30. Eccentric 84 surrounds shaft 82, which is otherwise generally centered with regard to diaphragm assemblies 30. Eccentric 84, in response to rotation of shaft 82 driven by motor 14, results in drive element 54 moving in a reciprocating, non-rotational movement. Stated another way, drive unit 54 follows a circular, non-rotational path about the axis of shaft 82 by virtue of eccentric 84. The reciprocating drive element 54 is maintained in a rolling contact with a corresponding diaphragm 38 of diaphragm assemblies 30. The reciprocating movement of drive element 54 actuates or urges diaphragm 38 to move, providing a pumping action of fluid through the corresponding diaphragm assembly 30. During actuation of each diaphragm 38 of the plurality of diaphragm assemblies 30 in response to reciprocating movement of drive element 54, the drive element provides a continuously rigid radial coupling with the corresponding diaphragms 38. Due to the symmetrical arrangement of drive element 54 and multiple, such as 12, identical diaphragm assemblies 30, flow pulsation is minimized. The drive element 54 may then be operated at a relatively constant motor torque, due to the elimination of low speed cogging, and diaphragm assemblies and corresponding portions of the drive element are subjected to substantially equal operating loads by virtue of the symmetrical arrangement and identical component construction.

As shown, diaphragm assemblies 30 are disposed in a uni-planar, substantially equally spaced radial array. However, in other embodiments, the diaphragm assemblies 30 may be disposed in multiple planes and in a non-uniformly spaced radial arrangement.

Figure 3:
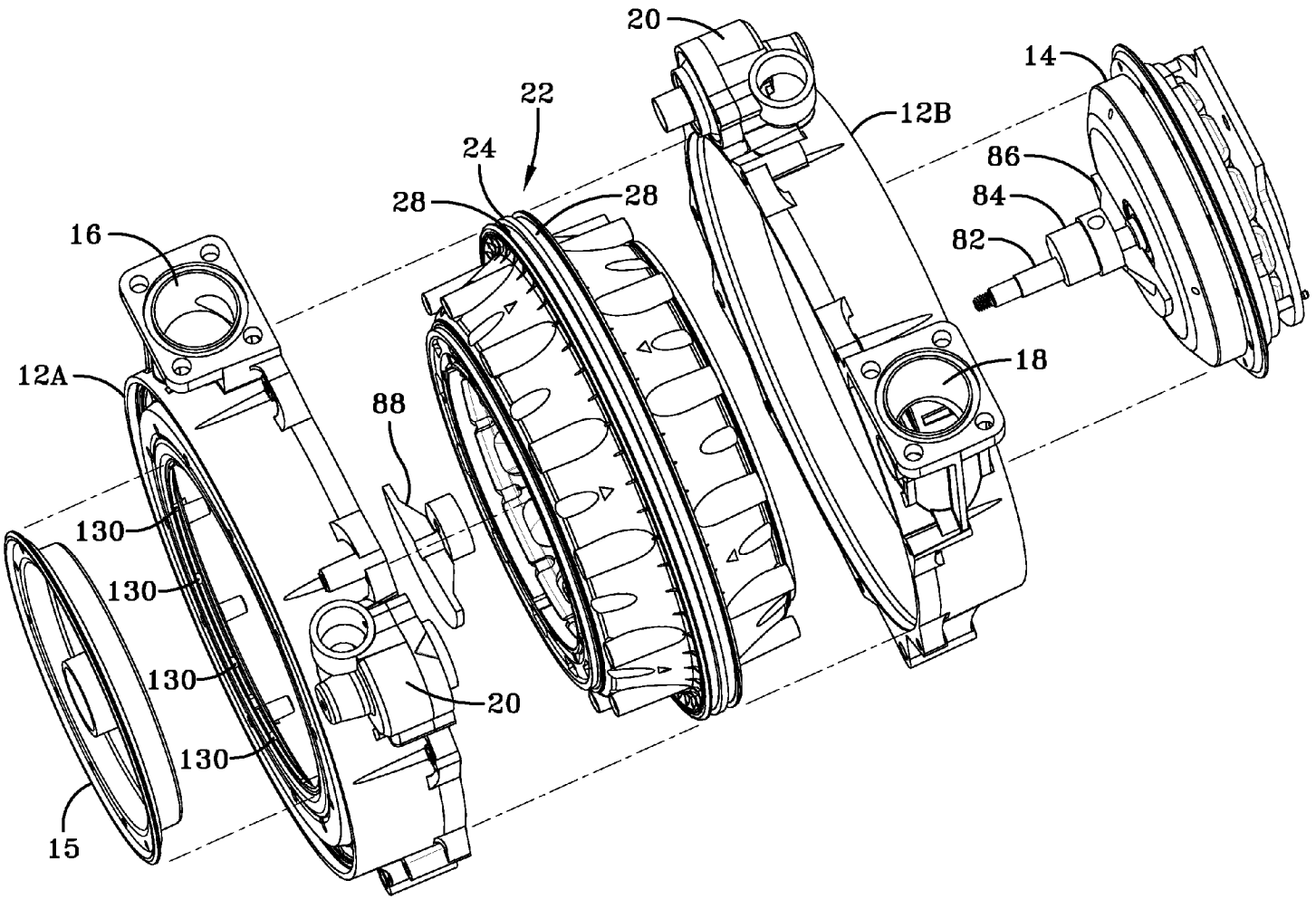
FIG. 3 shows an exploded perspective view of the pump of FIGS. 1 and 2.
Figure 4:
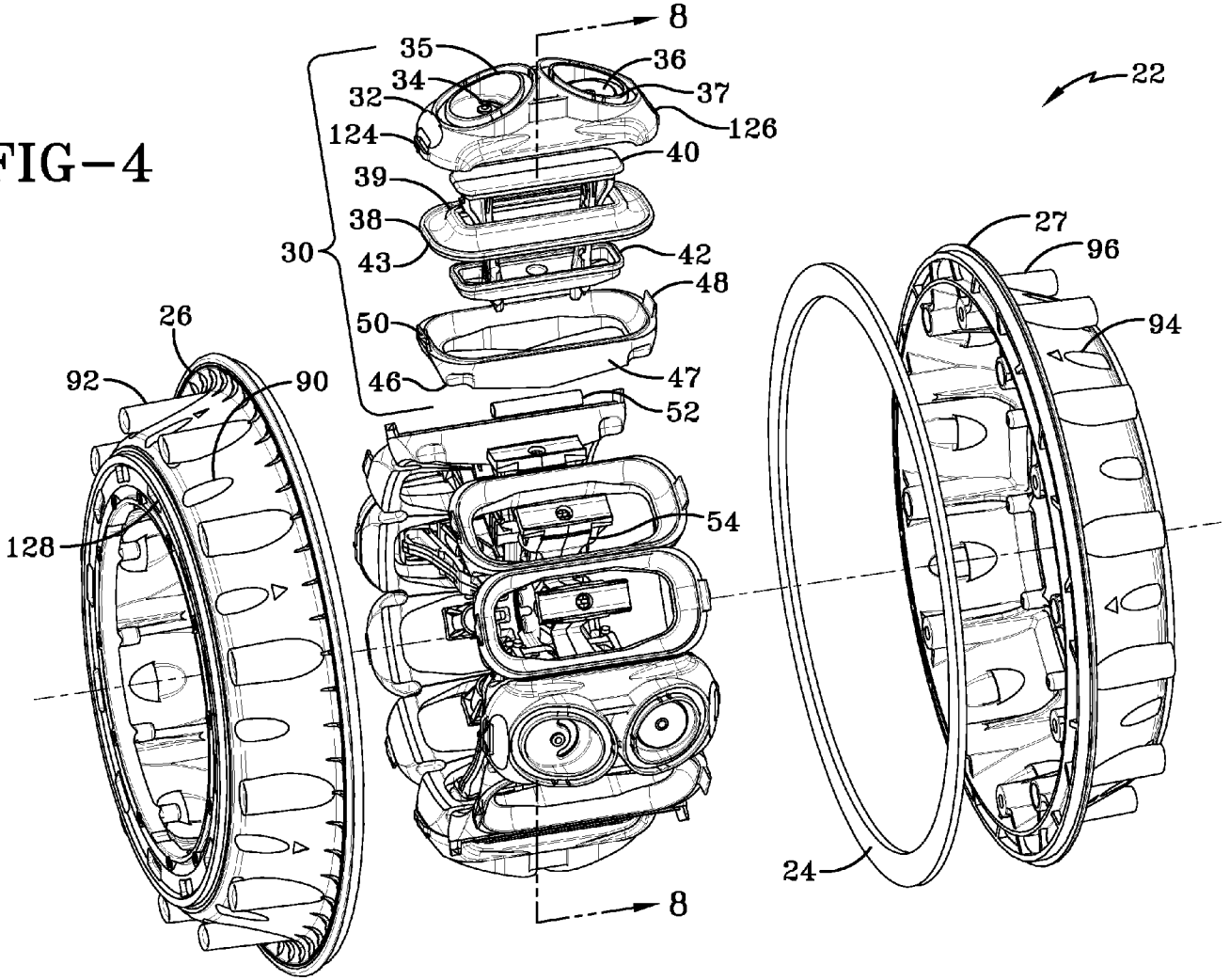
FIG. 4 shows an exploded perspective view of an exemplary core assembly of a fluid pump.
Figure 5:
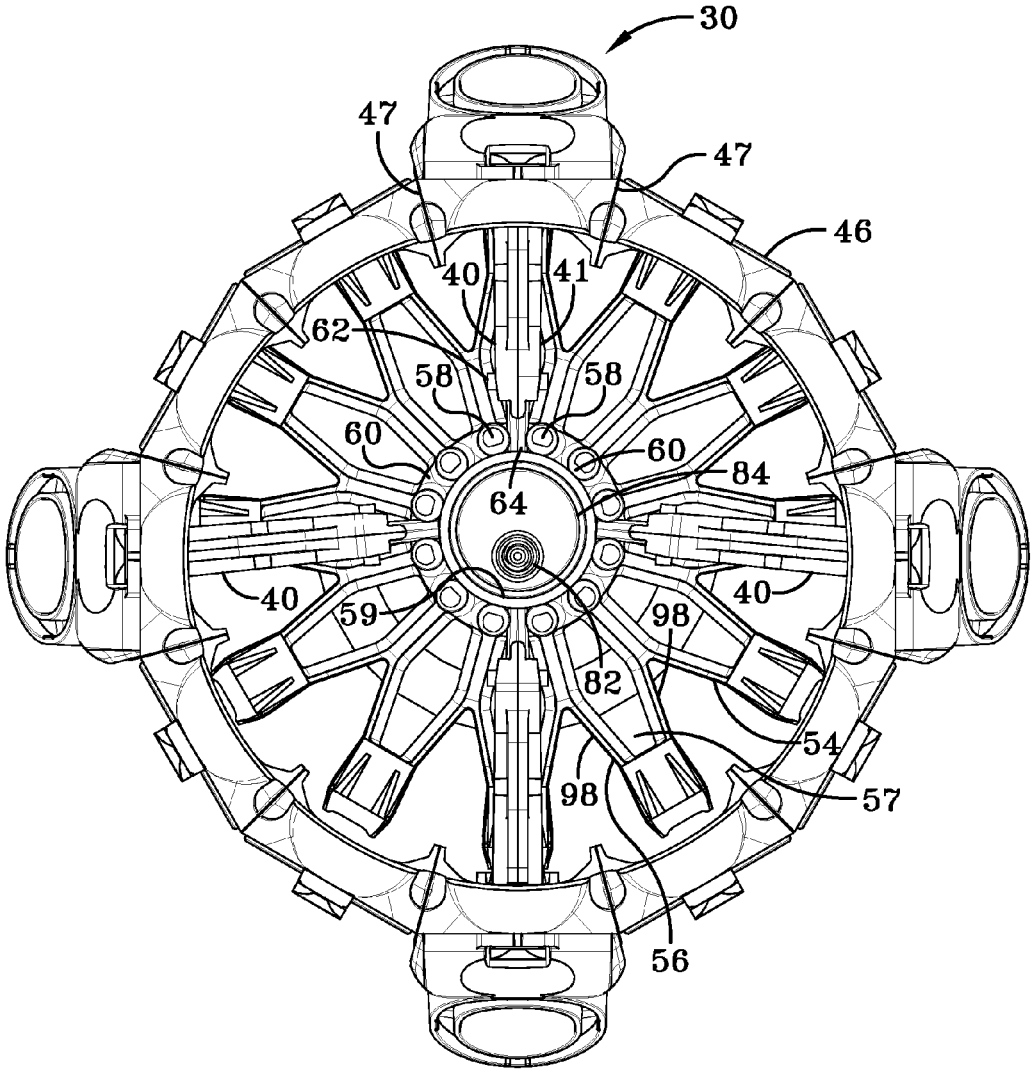
FIG. 5 shows an end view of a core assembly of the fluid pump of FIG. 4, with a manifold portion removed.

FIG. 4 shows an exploded view of diaphragm assembly 30 including a valve plate 32 having a valve 34 on an inlet side and a valve 36 on an outlet side of the valve plate. A diaphragm 38 is secured along an inner edge 39 to a clip 40 by a support 42. Clip 40 is also movably secured to and is included with drive element 54. A mounting plate 46 includes mounting features 48, 50 for facilitating assembly of mounting plate 46 to valve plate 32. Once installed, diaphragm assembly 30 is fully secured between the inner surfaces of manifolds 26, 27 and the external cylindrical surfaces of both motor 14 and a bearing plate 15 (FIG. 3). Collectively, diaphragm assembly 30 includes a valve plate 32, clip 40, diaphragm 38, mounting plate 46 and support 42. Mounting plate 46 includes opposed tapered surfaces 47, permitting adjacent mounting plates 46 to abut each other in a radial arrangement. As shown in FIG. 5, surfaces 47 are configured so that mounting plates 46 are substantially equally angularly spaced in a radial arrangement. Although twelve mounting plates 46 (forming portions of twelve diaphragm assemblies 30) are employed in the exemplary embodiment (FIG. 5), more than twelve or less than twelve mounting plates (and diaphragm assemblies) may be used in alternate pump configurations. A valve pumping chamber 44 can be defined between valve plate 32, diaphragm 38 and clip 40. (See e.g., FIG. 8A) That is, in response to driven movement of clip 40 as part of drive element 54, diaphragm 38 is actuated for drawing fluid into or expelling fluid from chamber 44 of diaphragm assembly 30.

As shown in FIGS. 3-5, core assembly 22 includes manifold portions 26, 27, which surround and enclose drive element 54 and may be assembled by directing a fastener, such as a threaded fastener (not shown), into respective guided openings 90, 94 formed in the manifold portions that are aligned prior to assembly. A backing plate 24 may be disposed between manifold portions 26, 27 to position O-rings (not shown) to effect a fluid tight seal between the backing plate 24 and manifold portions 26, 27. Valve plate 32 includes an extension structure 35 surrounding valve 34 and facing away from diaphragm 38. Valve plate 32 also includes an extension structure 37 surrounding valve 36 and facing away from diaphragm 38. Extension structures 35 form a tapered annular (conical) surface (O-rings not shown in extension structures) that face the corresponding mating surface of manifold portion 26 and provides a fluid tight seal between the extension structures and manifold portion 26 upon assembly. Similarly, extension structures 37 form a tapered annular surface (O-rings not shown in extension structures) that face the corresponding mating surface of manifold portion 27 and provides a fluid tight seal between the extension structures and manifold portion 27 upon assembly.

Manifold portion 26 includes a plurality of openings 92 that are each aligned with a corresponding extension structure 35 of a valve 34. Similarly, manifold portion 27 includes a plurality of openings 96 that are each aligned with a corresponding extension structure 37 of a valve 36. In response to actuation of diaphragm 38 in one direction, fluid is drawn through opening 92, extension structure 35, valve 34 and then into chamber 44 of diaphragm assembly 30. In response to actuation of diaphragm 38 in the other direction, fluid is expelled from chamber 44 of diaphragm assembly 30, through valve 36, extension structure 37 and then through opening 96 of manifold portion 27. In one embodiment, manifold portions 26, 27 can be substantially identical. In a further embodiment, each of the components of diaphragm assembly 30 can be substantially identical.

Figure 6:
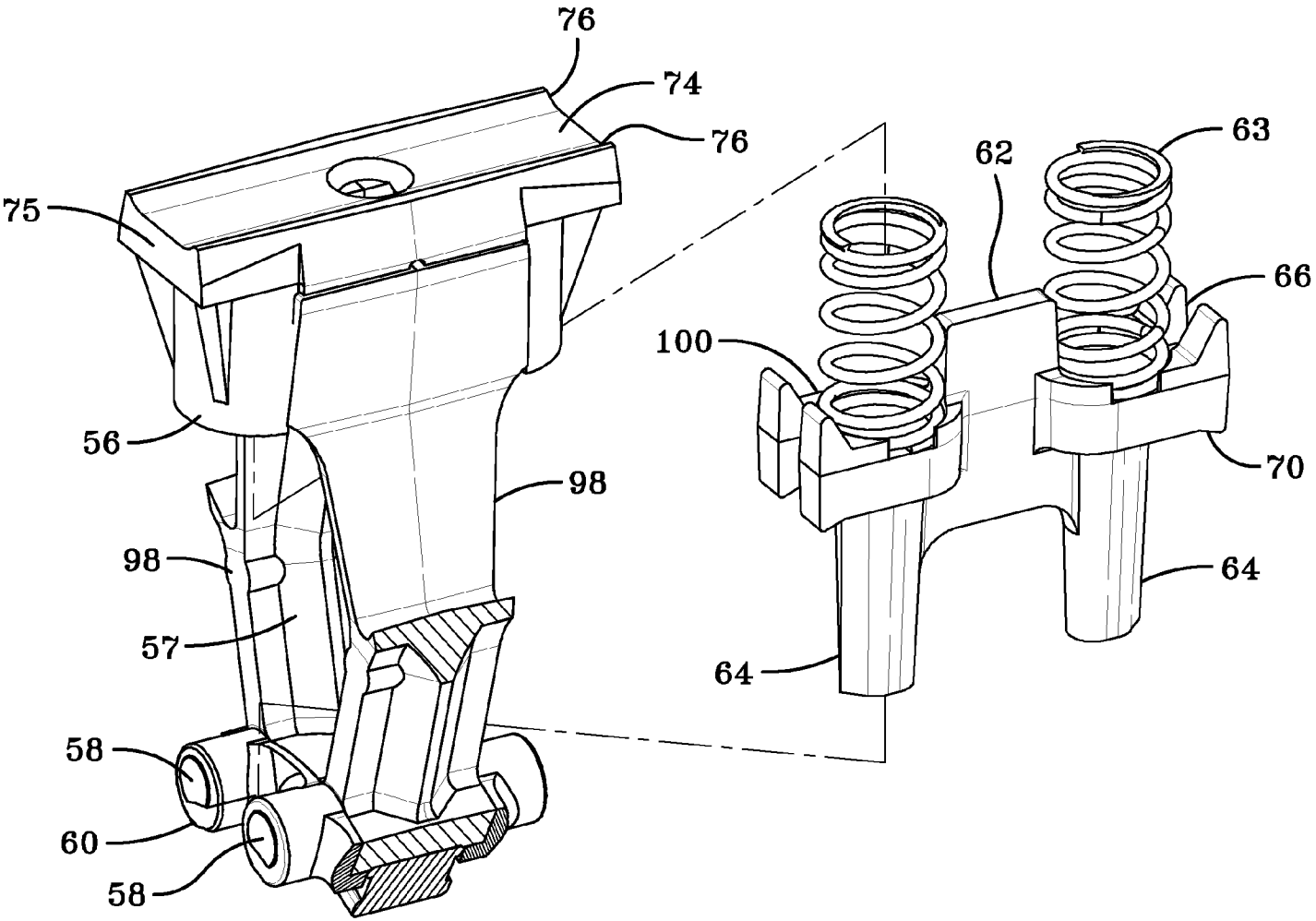
FIG. 6 shows an enlarged, partially exploded view of a partially assembled drive element of the core assembly of FIG. 5.
Figure 7:
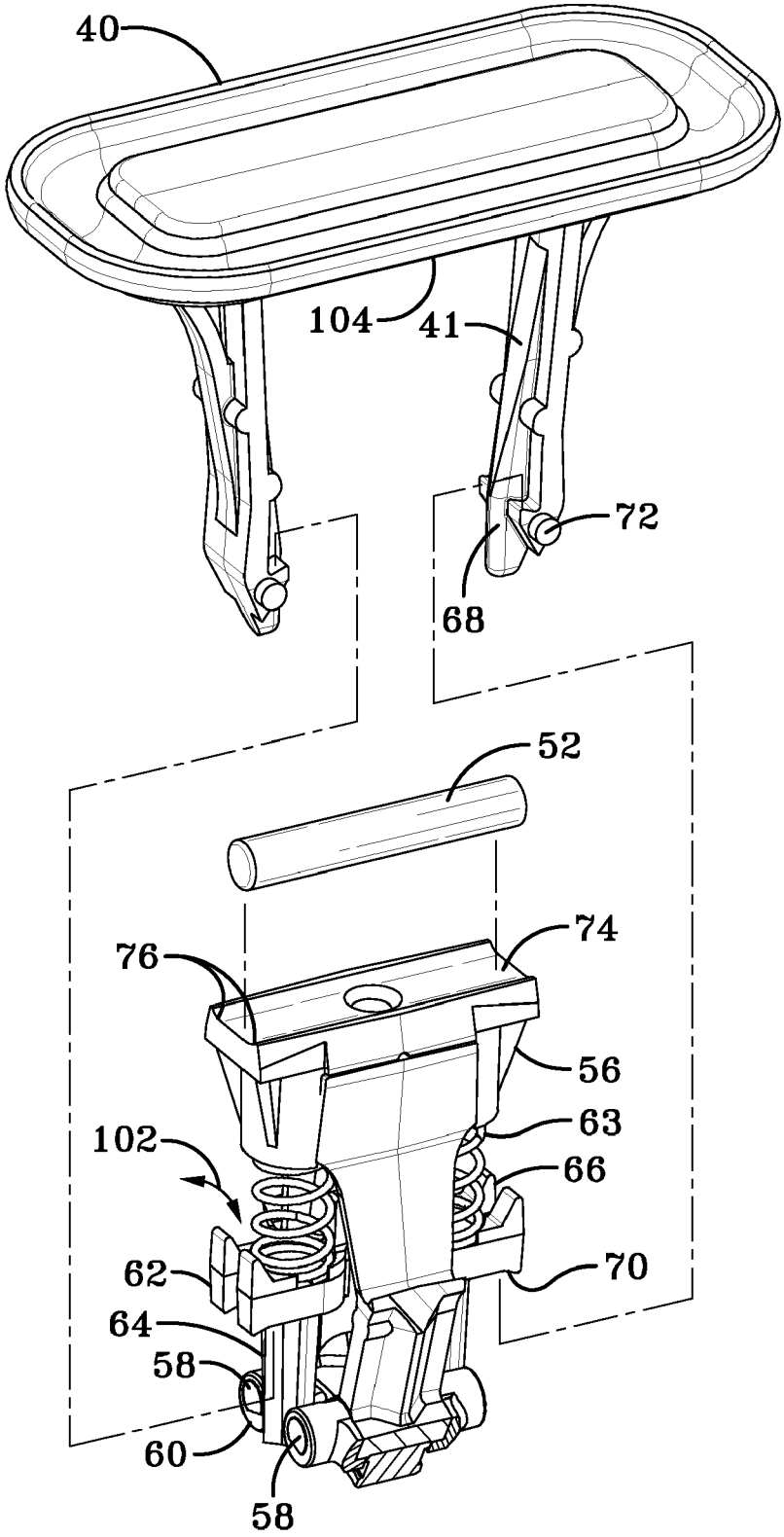
FIG. 7 shows an enlarged, partially exploded view of the partially assembled drive element of the core assembly of FIG. 6.

As shown in FIGS. 5-7, drive element 54 includes a spoke member 56 having a generally centered opening 59 for receiving eccentric 84 and shaft 82 of motor 14 (FIG. 3). This eccentric coupling results in reciprocating movement of spoke member 56 about the center of rotation of shaft 82. In one embodiment, spoke member 56 has a substantially planar construction, that is, the center line of each spoke of spoke member 56 is coplanar. Each spoke of spoke member 56 corresponds to a diaphragm assembly 30. Positioned near center opening 59 of spoke member 56 are a plurality of protrusions 58 extending outwardly and substantially perpendicular to the spokes. Protrusions 58 may be arranged so that a pair of protrusions are positioned at the base of each spoke of spoke member 56. An annular bushing 60 composed of resilient material may be slid over and collectively cover protrusions 58. Each spoke of spoke member 56 (FIG. 6) of drive element 54 includes a pair of legs 98 separated by an opening 57. In one embodiment, legs 98 corresponding to a spoke member 56 are bowed away from each other to increase the size of opening 57. In a further embodiment, legs 98 of adjacent spokes of spoke member 56 are partially joined together, resembling a "Y" in one embodiment, providing additional structural integrity to drive element 54. Positioned at the end of legs 98 facing away from center opening 59, an end member 75 having a channel 74 is oriented parallel to the center line of the center opening that receives motor shaft 82. In one embodiment, end member 75 forms a snap-fit with spoke member 56. Channel 74 defines a radially outwardly facing surface including a pair of opposed raised edges 76 configured to rotatably receive and limit rotational travel of a roll pin 52 positioned in channel 74 during operation of the pump.

A spring support 62 is configured for insertion into each opening 57 of each spoke of spoke member 56. Spring support 62 includes a pair of legs 64 that are directed to extend between protrusions 58 of drive element 54 (FIG. 7) so that spring support 62 straddles spoke member 56. A pair of recessed portions 100 are formed in spring support 62 to each receive a spring 63 that is sized for the pump application. When installed, spring 63 is compressed between recessed portion 100 and spoke member 56, retaining spring support 62 in position within opening 57. Although spring support 62 is retained in opening 57 of spoke member 56, relative rotational movement 102 (FIG. 7) of spring support 62 with respect to spoke member 56 is not prevented. Rotational movement 102 occurs about an axis that is substantially parallel to motor shaft 82 (FIG. 3).

As further shown in FIG. 7, in which diaphragm 38 and support 42 are removed for purposes of clarity, clip 40 includes a pair of legs 41 having a guide feature 68 and a locking feature 72 positioned near the end of each leg. Clip 40 may be movably secured to spoke member 56 by directing guide feature 68 into aligned engagement with guide feature 66 of spring support 62 until locking feature 72 engages a locking feature 70 of the spring support. As a result of maintaining springs 63 in a compressed condition, channel 74 of spoke member 56 is urged toward a surface 104 of clip 40 facing channel 74. The facing clip surface 104 is shown in cross section in FIG. 8A. Referring back to FIG. 4, in which clip 40 is assembled to diaphragm 38 and support 42, FIG. 8A shows that while surface 104 faces channel 74 of spoke member 56, a corresponding surface of support 42 directly faces channel 74 of spoke member 56. The corresponding surface of support 42 defines a channel 78 having opposed raised edges 80. Insertion of a roll pin 52 between channel 74 and channel 78 provides a collective rolling contact between spoke member 56 and clip 40, permitting relative movement between spoke member 56 and clip 40. In addition to the relative movement, drive element 54, which includes the combination of spoke member 56, clip 40 and support 42, provides a continuously rigid radial coupling with diaphragm 38.

By virtue of the continuously rigid radial coupling of drive element 54 and diaphragm 38 of each of diaphragm assemblies 30, the position of the diaphragms within each diaphragm assembly may be controlled with a high degree of precision. Such precise positional control of the diaphragms 38 similarly permits precise metering of fluid flow through the diaphragm assemblies 30, as well as allows for high operating speeds by preventing significant radial distortion due to forces arising from centripetal acceleration. In addition, by virtue of the rolling contact maintained between drive element 54 and each diaphragm 38, the portion of clip 40 secured to diaphragm 38 maintains radial support of the diaphragm while remaining substantially perpendicular to the direction of radial support. Stated another way, during operation of the pump, despite reciprocating movement of drive element 54 that defines a circular or eccentric, but non-rotational (non-spinning) motion or rectilinear movement of the spokes of spoke member 56 and resulting in a center axis of channel 74 of each spoke of spoke member 56 to deviate significantly between misaligned and aligned positions with respect to the centered radial axis of each diaphragm assembly 30, the radially supported axis of clip 40 securing diaphragm 38 remains substantially aligned with respect to the centered radial axis. Such substantial alignment substantially reduces differential lateral movement between opposed lateral portions of diaphragms 38 during actuation of the diaphragms, resulting in an extended service life of the diaphragms. In one embodiment, diaphragm differential lateral movement may be effectively eliminated.

Figure 8:
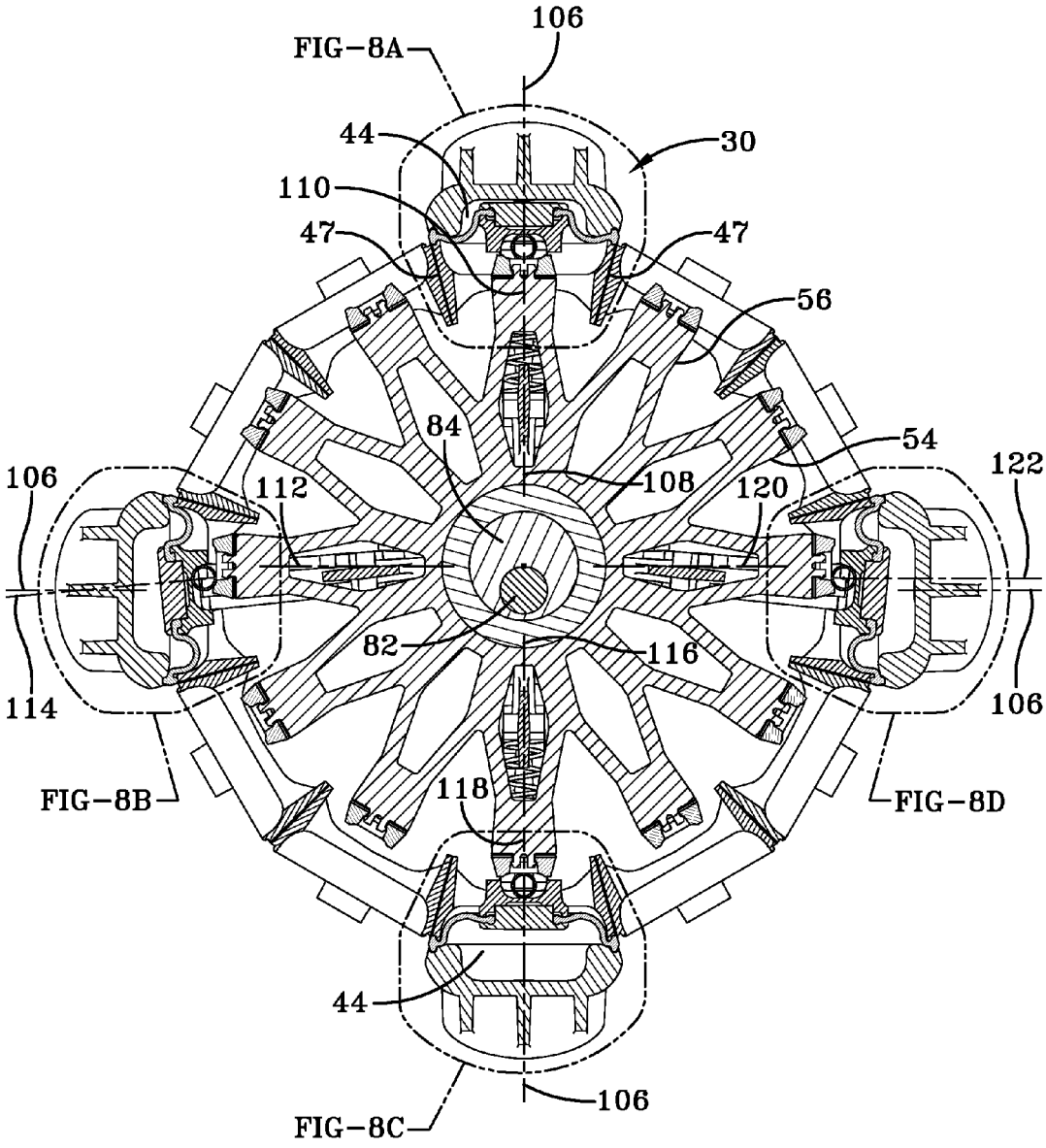
FIG. 8 shows a cross section of an assembled drive element and assembled diaphragm assemblies taken along line 8-8 from FIG. 4.
Figure 8A:
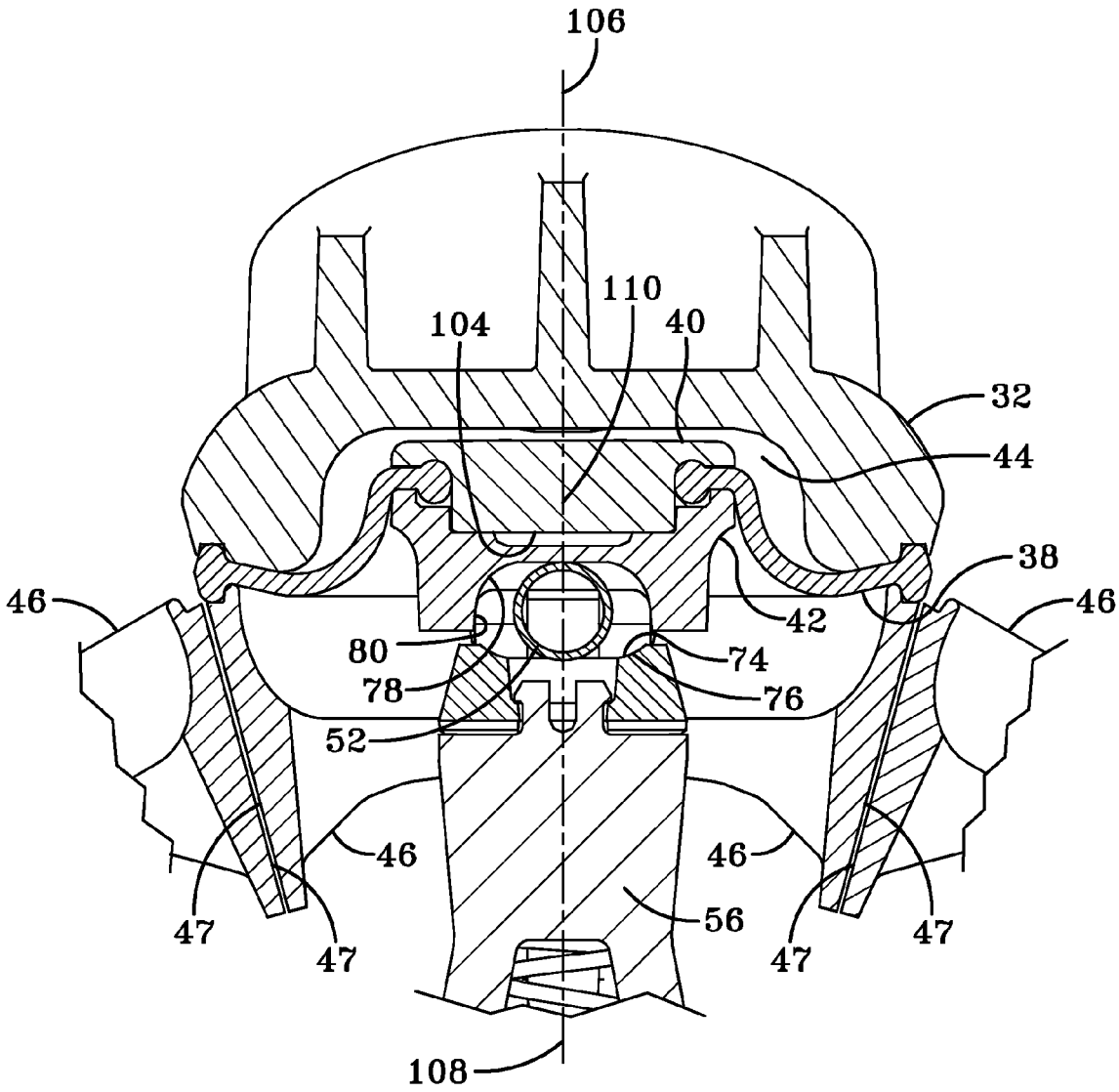
FIGS. 8A, 8B, 8C and 8D show enlarged cross sectional regions of respective regions 8A, 8B, 8C and 8D taken from FIG. 8.

FIGS. 8 and 8A through 8D will be used to more clearly illustrate the reduction in differential lateral movement between opposed lateral portions of diaphragm 38 of the diaphragm assemblies 30. FIG. 8 shows a cross section of core assembly 22 fixed in a particular operating position, in which only four diaphragm assemblies 30 are shown, for purposes of clarity. The positions of diaphragms 38 in the four diaphragm assemblies 30 correspond to the following: 1) a fully closed valve pumping chamber 44, identified as region 8A in FIG. 8; 2) an intermediately open valve chamber 44, identified as region 8B in FIG. 8; 3) a fully opened valve chamber 44, identified as region 8C in FIG. 8; and 4) an intermediately open valve chamber 44, identified as region 8D in FIG. 8. It is to be understood that in response to one full revolution of motor shaft 82 with eccentric 84, drive element 54 will be urged into reciprocating movement such that each of the diaphragms of diaphragm assemblies 30 will transition between each of the four chamber 44 positions represented by regions 8A-8D.

FIGS. 8 and 8A show diaphragm assembly 30 corresponding to a fully closed valve chamber 44. In the fully closed position, channel 74 of spoke member 56 is located in a maximally extended position towards a valve plate 32 along a spoke axis 108 that is coincident with a centered radial axis 106. The centered radial axis 106 corresponds to an axis that bisects the angle subtended between opposed tapered surfaces 47 of diaphragm assembly 30. Similarly, a radially supported axis 110 is coincident with centered radial axis 106. Radially supported axis 110 extends through the opposed points of tangency of roll pin 52 disposed between channel 74 of spoke member 56 and channel 78 of support 42. In the fully closed position, due to spoke axis 108 and radially supported axis 110 being coincident with centered radial axis 106, there is virtually nonexistent differential lateral loading of diaphragm 38.

Figure 8B:
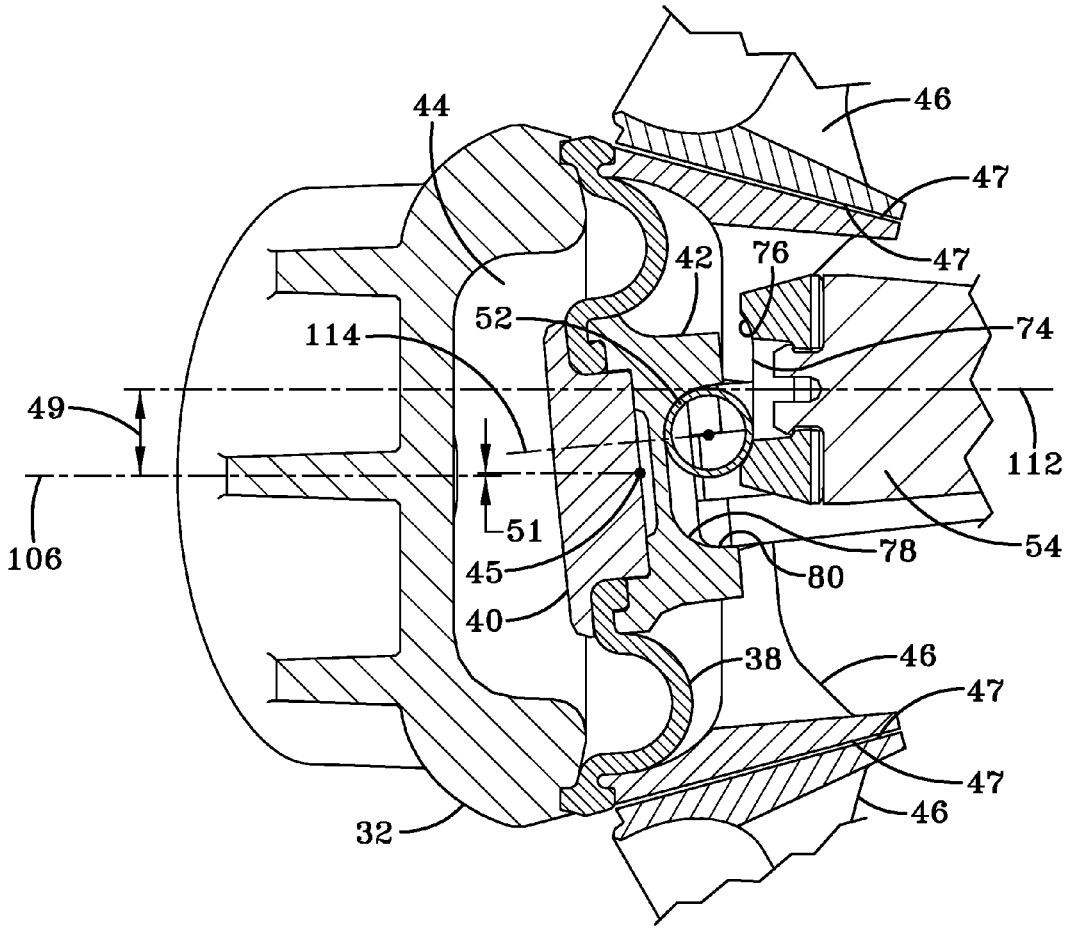

FIGS. 8 and 8B show diaphragm assembly 30 corresponding to a partially closed valve chamber 44. In the partially closed position, channel 74 of spoke member 56 is located in a partially extended position towards valve plate 32 and along a spoke axis 112 that remains parallel to radial axis 106, but is variably offset by the eccentric or reciprocating motion of spoke member 56. The centered radial axis 106 corresponds to an axis that bisects the angle subtended between opposed tapered surfaces 47 of diaphragm assembly 30. A radially supported axis 114 is disposed at an angle with respect to centered radial axis 106. Radially supported axis 114 extends through the opposed points of tangency of roll pin 52 disposed between channel 74 of spoke member 56 and channel 78 of support 42. Roll pin 52 abuts respective raised edges 76, 80 of channels 74, 78, maintaining the roll pin in the channels. The center of spoke axis 112 is offset from the centered radial axis 106 and the center 45 of clip 40 by a distance 49, which if directly coupled with diaphragm 38, would result in significant differential lateral movement stressing of the diaphragm during operation.

However, due to the rolling contact established by roll pin 52 disposed between channel 74 of spoke member 56 and channel 78 of support 42 secured to clip 40, the radially supported axis 114 is positioned at a small angle with respect to centered radial axis 106, while maintaining the position of diaphragm 38 in a substantially centered position in diaphragm assembly 30. In one embodiment, radially supported axis 114 is substantially parallel to centered radial axis 106. That is, a significantly reduced distance 51 separates the center 45 of clip 40 and centered radial axis 106. This significantly reduced distance 51 as compared to distance 49 results in significantly reduced differential lateral loading to diaphragm 38 and providing extended operating life of the diaphragm. In other words, each diaphragm 38 is continuously actuated along radially supported axis 114 in which an angular orientation of an actuating region of clip 40 of the diaphragm secured to the second member is maintained substantially perpendicular to the radially supported axis 114. The actuating region of clip 40 is the portion of the clip that is secured to the inner edge 39 of diaphragm 38 (FIG. 4). Stated differently, radially supported axis 114 is maintained substantially parallel to centered radial axis 106 while maintaining the position of diaphragm 38 in a substantially centered position in diaphragm assembly 30.

Figure 8C:
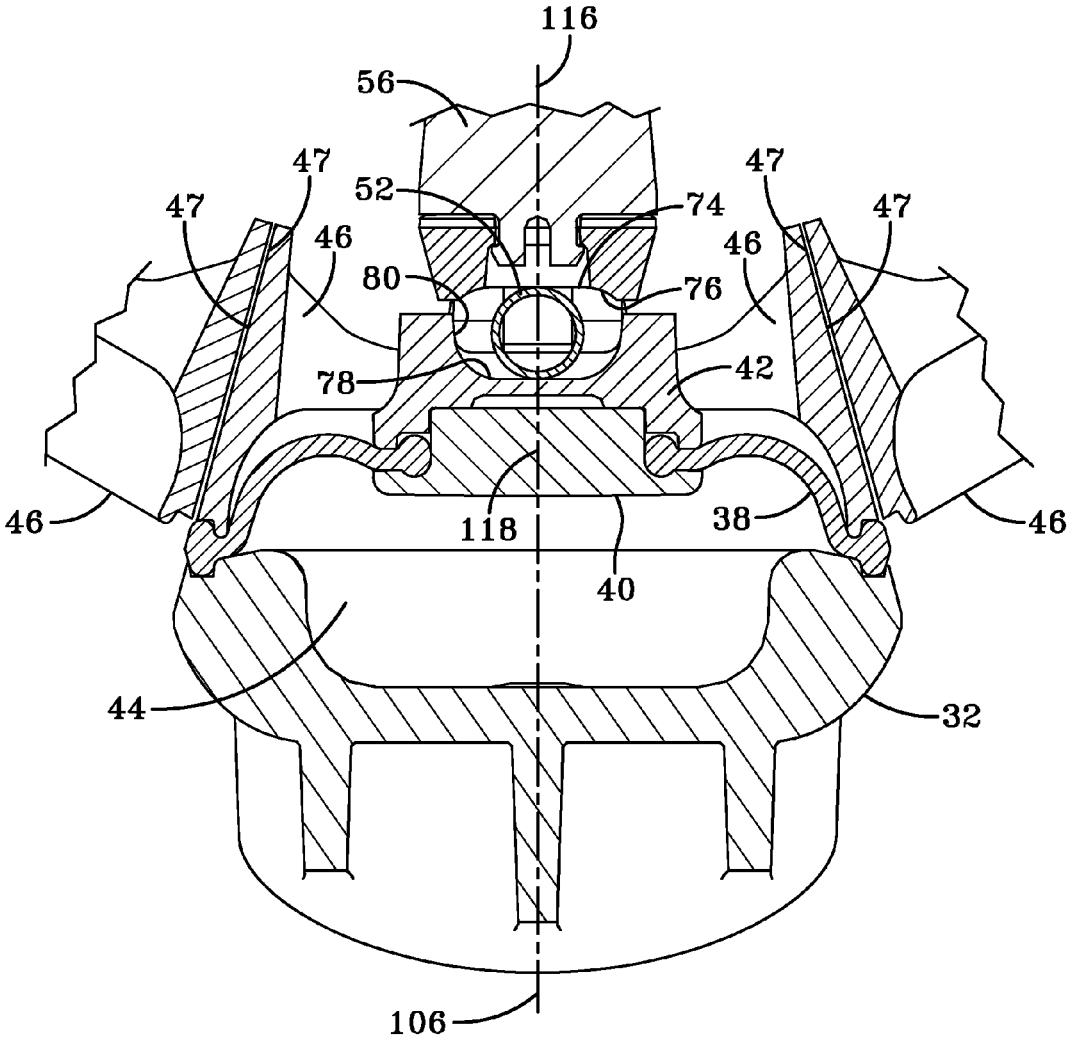

FIGS. 8 and 8C show diaphragm assembly 30 corresponding to a fully opened valve chamber 44. In the fully opened position, channel 74 of spoke member 56 is located in a minimally extended position towards valve plate 32 along a spoke axis 116 that is coincident with centered radial axis 106. The centered radial axis 106 corresponds to an axis that bisects the angle subtended between opposed tapered surfaces 47 of diaphragm assembly 30. Similarly, a radially supported axis 118 is coincident with centered radial axis 106. Radially supported axis 118 extends through the opposed points of tangency of roll pin 52 disposed between channel 74 of spoke member 56 and channel 78 of support 42. In the fully opened position, due to spoke axis 116 and radially supported axis 118 being coincident with centered radial axis 106, there is virtually nonexistent differential lateral loading of diaphragm 38.

Figure 8D:
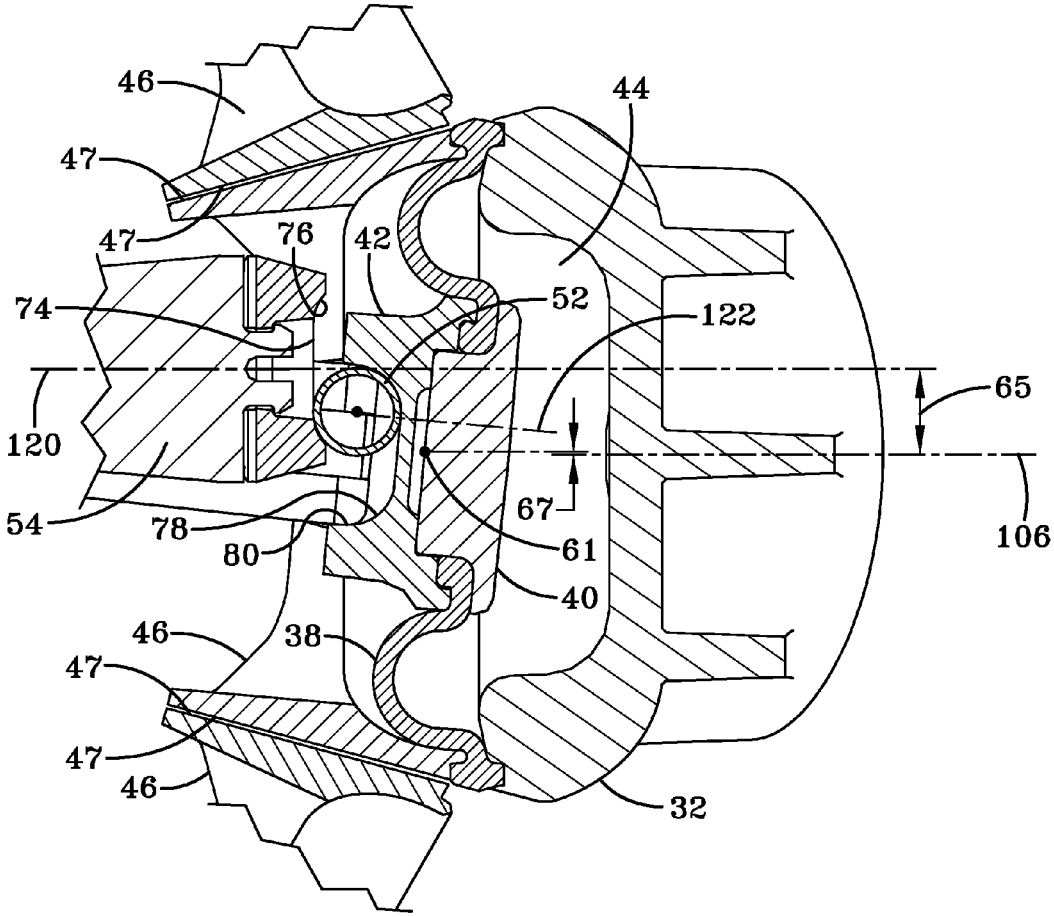

FIGS. 8 and 8D show diaphragm assembly 30 corresponding to a partially opened valve chamber 44. In the partially opened position, channel 74 of spoke member 56 is located in a partially extended position towards valve plate 32 and along a spoke axis 120 that remains parallel to radial axis 106, but is variably offset by the eccentric or reciprocating motion of spoke member 56. The centered radial axis 106 corresponds to an axis that bisects the angle subtended between opposed tapered surfaces 47 of diaphragm assembly 30. Similarly, a radially supported axis 122 is disposed at an angle with respect to centered radial axis 106. Radially supported axis 122 extends through the opposed points of tangency of roll pin 52 disposed between channel 74 of spoke member 56 and channel 78 of support 42. Roll pin 52 abuts respective raised edges 76, 80 of channels 74, 78, maintaining the roll pin in the channels. The center of spoke axis 120 is offset from the centered radial axis 106 and a center 61 of clip 40 by a distance 65, which if directly coupled with diaphragm 38, would result in significant differential lateral movement stressing of the diaphragm during operation.

However, due to the rolling contact established by roll pin 52 disposed between channel 74 of spoke member 56 and channel 78 of support 42 secured to clip 40, the radially supported axis 122 is positioned at a small angle with respect to centered radial axis 106, while maintaining the position of diaphragm 38 in a substantially centered position in diaphragm assembly 30. In one embodiment, radially supported axis 122 is substantially parallel to centered radial axis 106. That is, a significantly reduced distance 67 separates the center 61 of clip 40 and centered radial axis 106. This significantly reduced distance 67 as compared to distance 65 results in significantly reduced differential lateral loading to diaphragm 38 and providing extended operating life of the diaphragm. In other words, each diaphragm 38 is continuously actuated along radially supported axis 122 in which an angular orientation of an actuating region of clip 40 of the diaphragm secured to the second member is maintained substantially perpendicular to the radially supported axis 122. The actuating region of clip 40 is the portion of the clip that is secured to the inner edge 39 of diaphragm 38 (FIG. 4). Stated differently, radially supported axis 122 is maintained substantially parallel to centered radial axis 106 while maintaining the position of diaphragm 38 in a substantially centered position in diaphragm assembly 30.

As a result of the continuously adjusted positions of the diaphragms within the diaphragm assemblies which provide a collective balancing of diaphragm actuating forces for a given position of motor shaft 82, the rotational torque required to maintain operation of the pump remains substantially constant. In one embodiment, the components associated with drive element 54 and diaphragm assembly 30 are identical, so that corresponding components of drive element 54 and diaphragm assembly 30 are subjected to substantially identical operating loads. In addition, due at least in part to the increased number of diaphragm assemblies 30, low speed cogging is sufficiently reduced to a level that may be considered insignificant, if not eliminated, permitting an extended dynamic range of pump operation. The extended dynamic range is sometimes expressed in the form of a turndown ratio, or difference between the upper and lower pump operating speeds, which can be at least one hundred to one. That is, in one embodiment, the pump can operate between about 60 revolutions per minute and about 6000 revolutions per minute. However, in other embodiments, the upper and lower bounds may extend outside these operating ranges.

In one embodiment, opposed ends of valve plate 32 can include differently identified indicia 124, 126 (FIG. 4) that is viewable exterior of an assembled core assembly 22. That is, for example, after diaphragm assemblies 30 are assembled into manifold portion 26 by directing indicia 124 into the manifold portion, indicia 124 may be viewed exterior of manifold portion 26 through slot 128 (FIG. 4). In addition, indicia 124 may also be viewed exterior of housing portion 12A through notch 130 (FIG. 3), in case housing 12 had been assembled over core assembly 22. With indicia 124 facing one side of pump, it may be confirmed that diaphragm assemblies 30 have been installed correctly. Alternately, after diaphragm assemblies 30 are assembled into manifold portion 27 by directing indicia 126 into the manifold portion, indicia 126 may be viewed exterior of manifold portion 27 through a notch (not shown in FIG. 7) similar to slot 128 formed in manifold portion 26. In addition, indicia 126 may also be viewed exterior of housing portion 12B through slot (not shown) in case housing 12 had been assembled over core assembly 22.

FIG. 3 shows a first counterweight 86 and a second counterweight 88 secured to motor shaft 82 on each side of eccentric 84. By virtue of the predetermined spacing between counterweights 86, 88 along motor shaft 82 with respect to drive element 54, dynamic balancing is achieved during operation of the pump, permitting virtually vibration free operation of the pump. In one embodiment, drive element 54 includes a substantially planar construction, that is, the center line of each spoke of spoke member 56 of the drive element is coplanar and substantially coincident with the center axis of drive element 54. Counterweights 86, 88, which are positioned on opposite sides of drive element 54 along motor shaft 82, are sized and arranged with respect to the drive element so that not only do the counterweights provide for a balanced arrangement with respect to motor shaft 82, but also substantially eliminates secondary torsional coupling, such as about a line extending through the center of motor shaft 82 that is also coincident with the planar construction of drive element 54. Due to this symmetrical arrangement of the counterweights with respect to drive element 54, vibration associated with operation of the pump is virtually eliminated. It is to be understood that the term dynamically balanced or dynamic balancing or the like refers to the symmetrical arrangement of the counterweights 86, 88 with respect to drive element 54 which results in vibration free pump operation, and does not require that an independent dynamic balancing procedure be additionally performed. As further shown in FIG. 3, relief valves 20 are provided to prevent pump malfunction in the event of an off-design operating condition, e.g., occluded pump inlet port or blocked outlet port.

It is to be understood that in one embodiment, no metal is present in the fluid path. That is, all components which are in contact with the fluid, including the core assembly, housing may be constructed of non-metals. In a further embodiment, fasteners are not required, making use of a snap-together construction or adhesives. In yet a further embodiment, the spoke member and clips may be of unitary construction.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pump comprising:

a housing;

a plurality of diaphragm assemblies radially disposed within the housing, each diaphragm assembly of the plurality of diaphragm assemblies comprising a diaphragm;

a drive element configured to be eccentrically coupled to a rotating shaft motor to actuate the diaphragm for each of the plurality of diaphragm assemblies to draw fluid into or expel fluid from the diaphragm assembly;

the drive element comprising:

a first member;

a spring support having a leg received by the first member and a locking feature for compressively securing the spring support to the first member with a spring, the spring support rotatably movable about an axis parallel to the shaft motor; and a plurality of second members, each second member of the plurality of second members being movably secured to the spring support and disposed between the first member and the diaphragm of each of the plurality of diaphragm assemblies, each second member also being maintained in contact with an inner edge of a corresponding diaphragm; and wherein during actuation of each diaphragm of the plurality of diaphragm assemblies, the corresponding first member, second member and spring support provide a continuously rigid radial coupling with the diaphragm, the second member maintaining radial support of the diaphragm while remaining substantially perpendicular to the direction of radial support during pump operation.

2. The pump of claim 1, wherein each diaphragm of the plurality of diaphragm assemblies is continuously actuated along a radially supported axis in which an angular orientation of an actuating region of the diaphragm secured to the second member is maintained substantially perpendicular to the radially supported axis.

3. The pump of claim 2, wherein the radially supported axis is maintained substantially parallel to a centered radial axis while maintaining the position of each diaphragm in a substantially centered position in the corresponding diaphragm assembly.

4. The pump of claim 1, wherein the drive element is configured to operate at a relatively constant torque.

5. The pump of claim 1, wherein the first member has a plurality of spokes with each second member of the plurality of second members corresponding to a spoke of the first member and being movable with respect to the spoke, each spoke of the first member and associated second member corresponding to a diaphragm assembly of the plurality of diaphragm assemblies.

6. The pump of claim 1, wherein the drive element comprises a pin to provide a rolling contact between the first member and the second member near the diaphragm of the plurality of diaphragm assemblies.

7. The pump of claim 1, wherein the plurality of diaphragm assemblies are radially disposed in a substantially equally angularly spaced arrangement within the housing.

8. The pump of claim 1, wherein the pump has a turndown ratio of at least 100:1.

9. The pump of claim 1, further comprising at least one bypass valve limiting differential pressure associated with the plurality of diaphragm assemblies.

10. The pump of claim 1, further comprising a rotating shaft motor eccentrically coupled to the drive unit, wherein the eccentric coupling is configured to operate in a dynamically balanced manner during operation.

11. The pump of claim 10, wherein the eccentric coupling further comprises counterweights disposed along the motor shaft and separated by the eccentric coupling.

12. The pump of claim 1, further comprising indicia formed on each diaphragm assembly of the plurality of diaphragm assemblies that may be viewed exterior of the housing after the housing has been assembled.

13. A pump comprising:

a housing;

a plurality of diaphragm assemblies radially disposed in a substantially equally angularly spaced arrangement within the housing, each diaphragm assembly of the plurality of diaphragm assemblies comprising a diaphragm;

a drive element configured to be eccentrically coupled to a rotating shaft motor to actuate the diaphragm for each of the plurality of diaphragm assemblies to draw fluid into or expel fluid from the diaphragm assembly;

the drive element comprising:

a first member having a plurality of substantially identical spokes;

a spring support having a leg received by the first member and a locking feature for compressively securing the spring support to the first member with a spring, the spring support rotatably movable about an axis parallel to the shaft motor; and a plurality of second members;

each second member of the plurality of second members corresponding to a spoke of the first member and movable with respect to the spoke by a corresponding spring support, each spoke of the first member, associated second member of the plurality of second members and spring supports corresponding to a diaphragm assembly of the plurality of diaphragm assemblies, each second member also being maintained in contact with an inner edge of a corresponding diaphragm; and wherein during actuation of each diaphragm of the plurality of diaphragm assemblies, the corresponding first member, second member of the plurality of second members and spring supports provide a continuously rigid radial coupling with the diaphragm, the second member maintaining radial support of the diaphragm while remaining substantially perpendicular to the direction of radial support during pump operation.

14. The pump of claim 13, wherein each diaphragm of the plurality of diaphragm assemblies is continuously actuated along a radially supported axis in which an angular orientation of an actuating region of the diaphragm secured to the second member of the plurality of second members is maintained substantially perpendicular to the radially supported axis.

15. The pump of claim 14, wherein the radially supported axis is maintained substantially parallel to a centered radial axis while maintaining the position of diaphragm in a substantially centered position in diaphragm assembly.

16. The pump of claim 13, wherein the drive element is configured to operate at a relatively constant torque.

17. A pump comprising:

a housing;

a plurality of diaphragm assemblies radially disposed in a substantially equally angularly spaced arrangement within the housing, each diaphragm assembly of the plurality of diaphragm assemblies comprising a diaphragm;

a drive element eccentrically coupled to a rotating shaft motor to actuate the diaphragm for each of the plurality of diaphragm assemblies to draw fluid into or expel fluid from the diaphragm assembly, wherein the eccentric coupling is configured to operate in a dynamically balanced manner during operation;

the drive element comprising:

a first member having a plurality of substantially identical spokes;

a spring support having a leg received by the first member and a locking feature for compressively securing the spring support to the first member with a spring, the spring support rotatably movable about an axis parallel to the shaft motor; and a plurality of second members;

each second member of the plurality of second members corresponding to a spoke of the first member and movable with respect to the spoke by a corresponding spring support, each spoke of the first member, associated second member of the plurality of second members and spring supports corresponding to a diaphragm assembly of the plurality of diaphragm assemblies, each second member also being maintained in contact with an inner edge of a corresponding diaphragm; and wherein during actuation of each diaphragm of the plurality of diaphragm assemblies, the corresponding first member, second member of the plurality of second members and spring supports provide a continuously rigid radial coupling with the diaphragm, the second member maintaining radial support of the diaphragm while remaining substantially perpendicular to the direction of radial support during pump operation.

18. The pump of claim 17, further comprising indicia formed on the diaphragm assembly of the plurality of diaphragm assemblies that may be viewed exterior of the housing after the housing has been assembled.

19. The pump of claim 17, wherein the pump has a turndown ratio of at least 100:1.

20. The pump of claim 17, wherein the eccentric coupling further comprises counterweights disposed along the motor shaft and separated by the eccentric coupling.

* * * * *